US007172070B2

(12) United States Patent
Coon et al.

(10) Patent No.: US 7,172,070 B2
(45) Date of Patent: Feb. 6, 2007

(54) WIRE-COIL PACKAGING DRUM WITH IMPROVED BOTTOM ASSEMBLY

(75) Inventors: Thomas D. Coon, Wilmington, DE (US); Randall Adams, Van Wert, OH (US)

(73) Assignee: Greif Bros. Corp. of Ohio, Inc., Delaware, OH (US)

( * ) Notice: Subject to any disclaimer, the term of this patent is extended or adjusted under 35 U.S.C. 154(b) by 0 days.

(21) Appl. No.: 09/937,282

(22) PCT Filed: Mar. 23, 2000

(86) PCT No.: PCT/US00/07679

§ 371 (c)(1),
(2), (4) Date: Dec. 28, 2001

(87) PCT Pub. No.: WO00/58181

PCT Pub. Date: Oct. 5, 2000

(65) Prior Publication Data

US 2004/0211694 A1 Oct. 28, 2004

Related U.S. Application Data

(60) Provisional application No. 60/126,338, filed on Mar. 26, 1999.

(51) Int. Cl.
*B65D 85/66* (2006.01)

(52) U.S. Cl. ..... 206/397; 206/408

(58) Field of Classification Search ..... 206/389, 206/397, 405, 409, 415, 416, 413, 303
See application file for complete search history.

(56) References Cited

U.S. PATENT DOCUMENTS

| | | | | | |
|---|---|---|---|---|---|
| 4,190,214 | A * | 2/1980 | Bond | 242/138 |
| 4,844,247 | A * | 7/1989 | Moy | 206/232 |
| 4,869,367 | A * | 9/1989 | Kawasaki et al. | 206/409 |
| 5,105,943 | A | 4/1992 | Lesko et al. | 206/397 |
| 5,664,712 | A * | 9/1997 | Smrt | 224/250 |
| 5,819,934 | A | 10/1998 | Cooper | 206/397 |
| 5,918,733 | A * | 7/1999 | Cerwin et al. | 206/63.3 |
| 6,341,691 | B1 * | 1/2002 | Voss | 206/397 |

FOREIGN PATENT DOCUMENTS

| | | |
|---|---|---|
| DE | 1808071 | 8/1970 |
| FR | 2761668 | 10/1998 |

OTHER PUBLICATIONS

Translation of 1808071.*

* cited by examiner

*Primary Examiner*—Shian T. Luong
(74) *Attorney, Agent, or Firm*—Baker & Hostetler LLP

(57) ABSTRACT

A game machine (2, 200) which includes a playing field (6, 301) traversed by objects, such as balls (320). The playing field can have plural drop zones (381–383) which can be selected by the player using deflectors (108–110) that control where the balls are launched. Detectors (22, 392) indicate scoring positions assumed by the balls. A payline display (28, 335) displays scored events. A symbol selector is included to select symbols which are variably assigned to the scoring positions and displayed on displays (20, 397). The balls score symbols which can be displayed in the payline display and affect winning or bonus play. Game machine (200) includes traditional slot machine reels which works in conjunction therewith.

34 Claims, 5 Drawing Sheets

WIRE-COIL PACKAGING DRUM WITH IMPROVED BOTTOM ASSEMBLY

CROSS-REFERENCE TO RELATED APPLICATION

This application claims the benefit of U.S. Application No. 60/126,338 filed Mar. 26, 1999.

BACKGROUND OF THE INVENTION

This invention relates to containers or drums used for packaging wire coils, and more specifically, to an improved bottom assembly for such containers or drums.

FIGS. 1 and 2 of the accompanying drawings illustrate a conventional wire-coil packaging drum 10 as disclosed in U.S. Pat. No. 5,105,943 to Lesko et al. (incorporated herein by reference). The drum 10, which is ordinarily made of pasteboard, includes a cylindrical drum body 12 and a bottom assembly 16 designed to anchor a hold-down system (to be described below) for a wire coil 30 received in the drum. The hold-down system serves as a dunnage for the wire coil during transport—specifically by applying a compressive force to the top of the coil to reduce shifting of the coil due to vibration and other movement of the drum.

The drum bottom assembly 16 includes a bottom heading 14 and a fixed-length strap 18 which is bent to form an upwardly (as shown) projecting central loop 20. The opposite end portions 22 of the strap are secured to the upper surface of the bottom heading by stapling, and an annular disk 24 is glued to the upper surface so as to cover the opposite ends of the strap and also to increase the strength of the drum bottom.

The hold-down system includes an elastic cord 34 provided with a hook 36 and a loop 38 at its opposite ends, respectively. An optional tubular, pasteboard core member 28 may be fitted over the looped portion 20 of strap 18 and received in a central opening 24*a* of the annular disk, where it is secured by gluing. The wire coil 30 is ordinarily formed directly in the drum by feeding the wire from a processing machine into the drum while rotating the drum about its central axis. Once the coil has been formed, the hold-down system is completed by upwardly stretching the elastic cord 34, hooked to the central loop 20, and passing a rigid bar 32 through the loop 38. The bar thus provides continuous compressive engagement with the coil under the tension of the elastic cord. The bar may compress the coil through the intermediary of an upper annular disk 40, which may be constituted by a pair of disk halves 42, as shown. Upon completion of the hold-down system, the drum may be sealed by attachment of a suitable top heading 46.

Although effective for its intended purpose, the above-described arrangement of the Lesko et al. patent is subject to several disadvantages in practice. For example, the fixed-length strap is attached to the upper surface of the bottom heading by staples or the like. This is a costly and labor-intensive operation. Further, this operation is performed before attaching the bottom heading to the drum body, thereby complicating the drum assembly process.

Other disadvantages stem from the fact that the elastic cord is not adjustable. As a result of this, the compressive force applied to the wire coil by the elastic cord cannot be adjusted. Further, the cord is limited to use only with drums within a certain height range. In order to accommodate drums over a wide range of heights, or to be able to adjust the amount of compressive force to be applied to a particular coil, it is necessary to maintain a supply of elastic cords having different lengths. This is inconvenient and leaves open the possibility that an assembly worker will mistakenly select an elastic cord of an incorrect length, so that the wire coil is not properly secured by the hold-down system.

One attempt to simplify the drum assembly process of the above-described arrangement is disclosed in U.S. Pat. No. 5,819,934 to Cooper (also incorporated herein by reference). The Cooper patent describes an arrangement in which a fixed-length strap is attached to the central tubular core rather than to the drum bottom heading. This eliminates the need to secure a strap to the bottom heading before the heading is attached to the drum body. However, the attachment of the strap to the core still constitutes a costly and labor intensive operation. In addition, the Cooper patent does not address the problems stemming from lack of adjustability of the elastic cord.

Accordingly, there remains a need for an improved construction that avoids the aforementioned disadvantages of the structure described in the Lesko et al. patent.

SUMMARY OF THE INVENTION

In accordance with one of its principal aspects, the present invention provides an improved bottom assembly in which the conventional bottom heading and strap arrangement are replaced by an arrangement including a bottom heading having a hole, and an anchoring member mounted to the bottom heading in cooperation with the hole such that an anchoring portion of the anchoring member is disposed to anchor a is hold-down system for container-received wire coil.

In a preferred implementation, the anchoring member comprises a molded plastic, snap-mounted plug having a generally cylindrical body provided with a laterally projecting flange portion and with at least one preferably resilient member projecting laterally from the body and axially displaced from the flange portion. The plug is mounted to the bottom heading by insertion of the plug member through the aforementioned hole. The projecting member is constructed to resiliently deform inwardly toward the body during insertion through the hole and to return toward an initial configuration after insertion such that the bottom heading is entrapped between the flange portion and the projecting member.

Also, in a preferred implementation, the conventional elastic cord is replaced by an elastic loop member, such as a rubber band, which is secured to the anchoring portion of the anchoring member by a tie. The tie may take any suitable form and in one preferred mode is constituted by a conventional cable tie having a ratchet-type closure mechanism, a lengthwise portion of the tie being passed through the elastic loop member and an opening of the anchoring portion prior to closure of the tie. A portion of the elastic loop member may be drawn up through a central tubular core of the drum (e.g., using a hook) for insertion of a rigid hold-down bar through the loop to compress the received wire coil. The bottom end of the core may be held in position by an annular disk as in the conventional drum. Use of the core and of the annular disk is optional, however.

Advantageously, the effective length of the elastic loop and tie assembly, and thus the compressive force exerted on the wire coil received in the drum, or the range of suitable drum heights, may be adjusted as desired by appropriately securing the tie in a desired length. For example, in the case of the aforementioned cable tie, the length may be set by passing a desired length of the tie through the ratchet closure.

BRIEF DESCRIPTION OF THE DRAWINGS

The foregoing and other aspects, features, and advantages of the invention will be more fully appreciated from the following detailed description of the preferred embodiments taken in conjunction with the accompanying drawings.

In the drawings.

FIG. 5 is a fragmentary side elevation of the anchoring member showing suitable dimensions (in inches) for snap-mounting the anchoring member into a 2-inch diameter circular hole in a bottom heading having a thickness of 0.12 in.

DETAILED DESCRIPTION OF THE PREFERRED EMBODIMENTS

Figure 1:
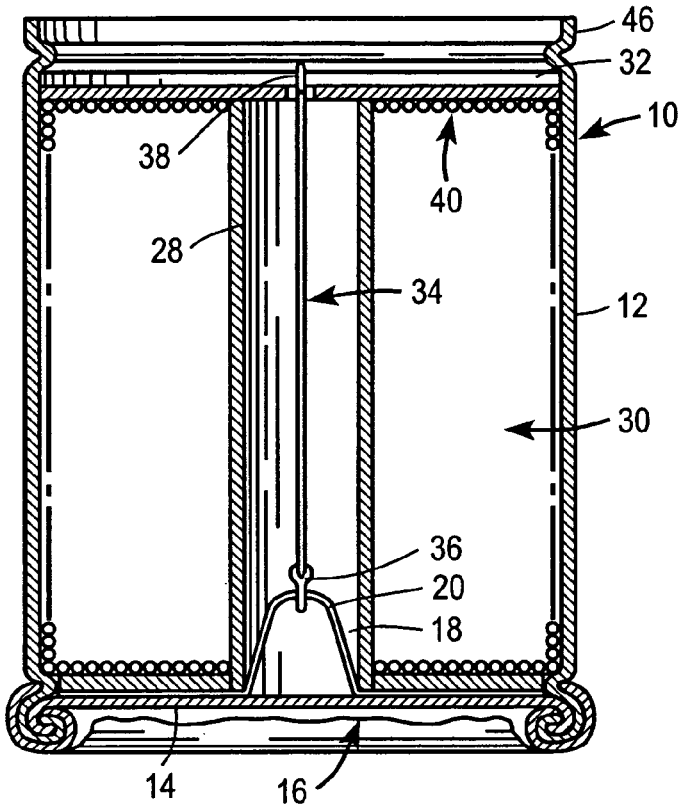
FIG. 1 (PRIOR ART)
FIG. 1 is a cross-sectional view of a conventional wire-coil packaging drum.
Figure 2:
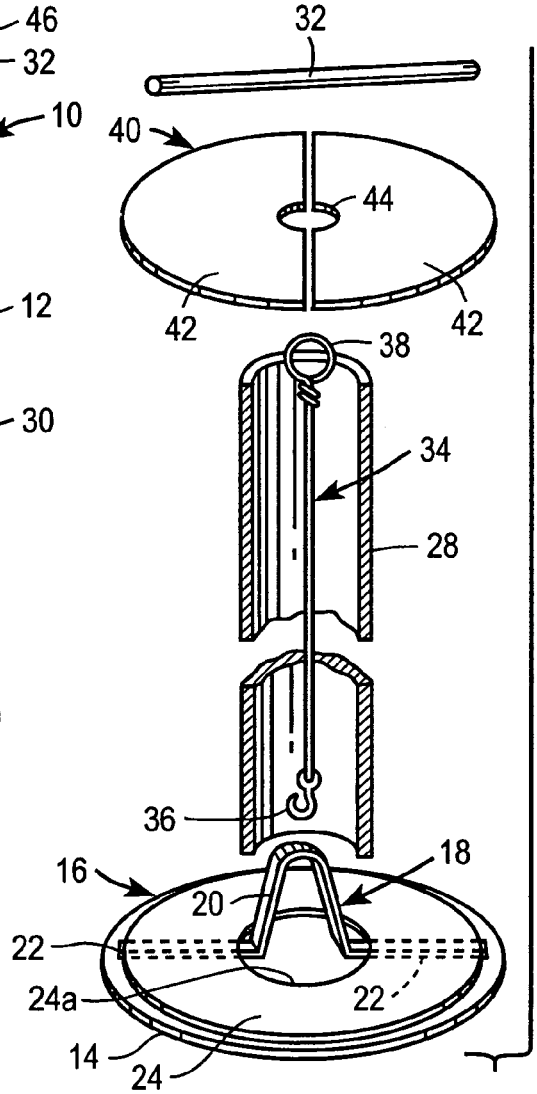
FIG. 2 (PRIOR ART)
FIG. 2 is an exploded perspective view of the bottom assembly and coil hold-down system of the drum in FIG. 1.
Figure 3:
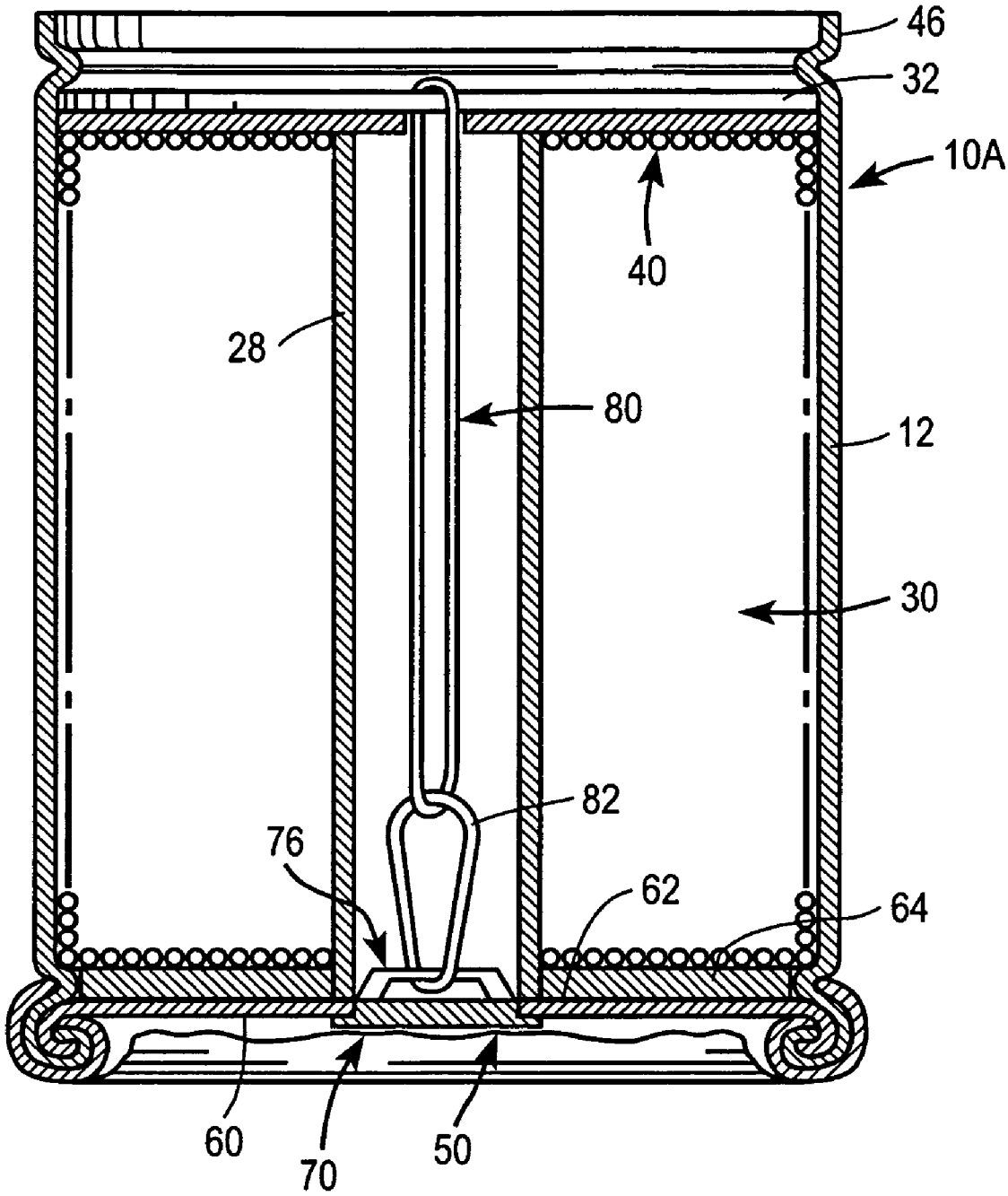
FIG. 3 is a cross-sectional view of an improved drum in accordance with the present invention.

FIG. 3 shows a wire-coil packaging drum 10A incorporating an improved bottom assembly and hold-down system according to the present invention. The structural differences between the drums shown in FIGS. 1 and 3 reside principally in the construction of the bottom assembly 50 and hold-down system. The following description will therefore focus on those portions of the drum.

The bottom assembly 50 comprises a drum bottom heading 60 having a central hole 62. The hole 62 is preferably circular, although it will be appreciated that other shapes may be suitable. An annular disk 64 may be mounted onto bottom heading 60 to provide strength, if desired, as in the conventional structure. An anchoring member 70 is mounted to the bottom heading 60 in cooperation with hole 62 such that an anchoring portion 76 of anchoring member 70 is disposed for anchoring a hold-down system for a wire coil 30, as will be explained shortly.

Figure 4:
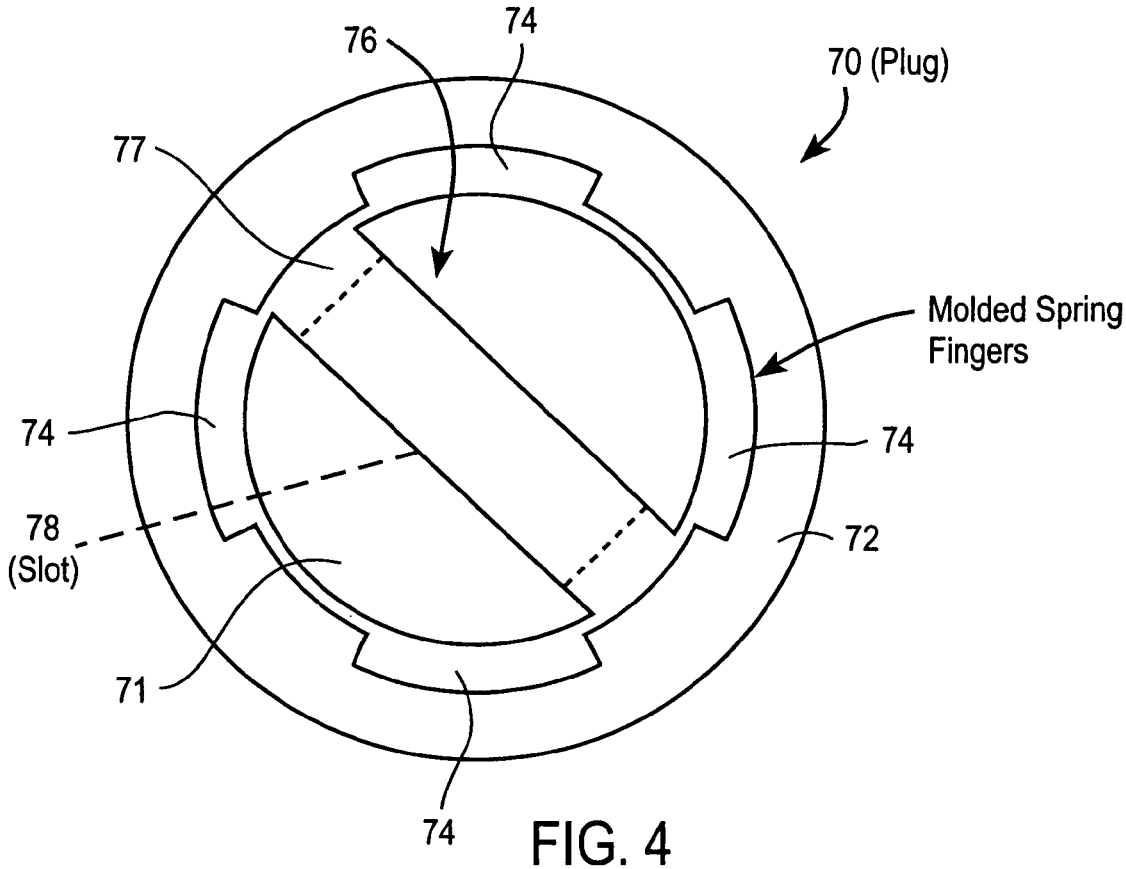
FIG. 4 is a plan view of an anchoring member used in the bottom assembly of the drum in FIG. 3.
Figure 5:
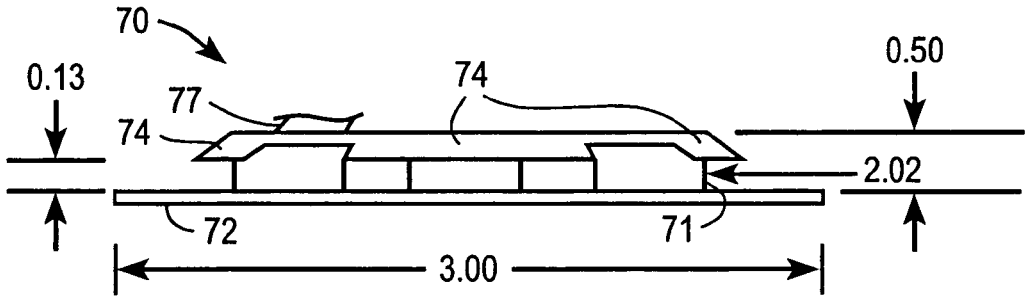
Figure 6:
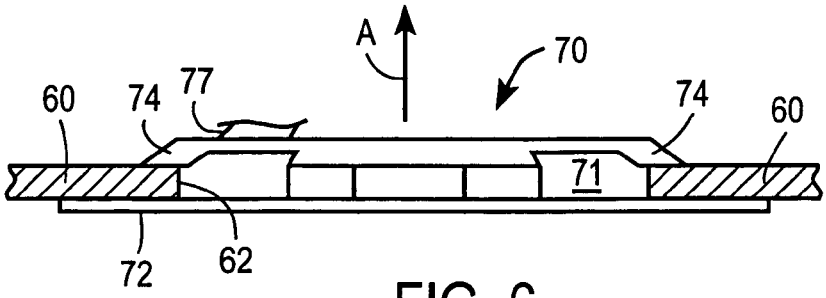
FIG. 6 is a view similar to FIG. 5 illustrating the anchoring member snap-mounted to the bottom heading.

Referring additionally to FIGS. 4–6, anchoring member 70 is preferably constituted by a snap-mounted plug having a body 71 of cross-sectional shape generally complementary to that of hole 62. In the form shown, plug body 71 is generally cylindrical with a diameter slightly smaller than that of hole 62. The plug 70 is further provided with a laterally projecting flange portion 72 and at least one laterally projecting, preferably resilient member 74 at positions of the body axially spaced from flange portion 72, there being four such members disposed at equal circumferential intervals in the illustrative form.

Plug 70 is preferably formed as a unitary plastic molding, as of HDPE (high density polyethylene), polypropylene, or any other suitable plastic, and in such form can be manufactured inexpensively, To reduce material cost, plug body 71 may have a hollowed out configuration. As a result of this, and of the simplified assembly procedure to be explained below, a substantial cost saving can be achieved relative to the conventional structure previously described.

In order to mount plug 70 to bottom heading 60, the plug is inserted upwardly through hole 62 as indicated by an arrow A in FIG. 6. As plug 70 moves through hole 62, members 74 are resiliently deformed inwardly toward the plug body 71 by engagement with the sidewalls of the hole. Once members 74 have cleared the hole, they return (snap) to their initial configuration such that bottom heading 60 is trapped between the upper surface of flange portion 72 and the lower surfaces of members 74 as best seen in FIG. 6. Although not necessary, it is preferred that the surfaces of flange portion 72 and resilient members 74 that engage the opposite surfaces of bottom heading 60 be parallel to the opposite surfaces of the bottom heading to maximize the area of engagement.

Plug 70 further comprises an anchoring portion 76, including a bridge-shaped member 77, which projects axially from the upper end of body 71, and an opening or slot 78 designed to receive a hold-down system.

Figure 8:
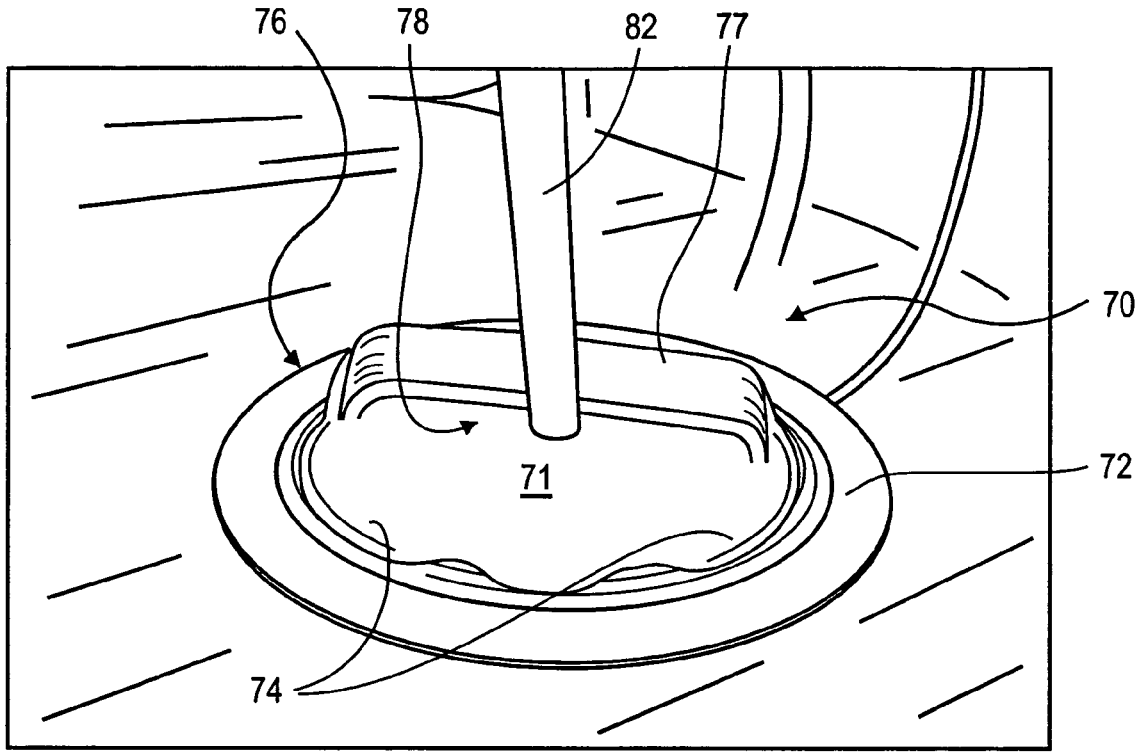
FIG. 8 is a perspective view of the anchoring member having a cable tie secured thereto.
Figure 7:
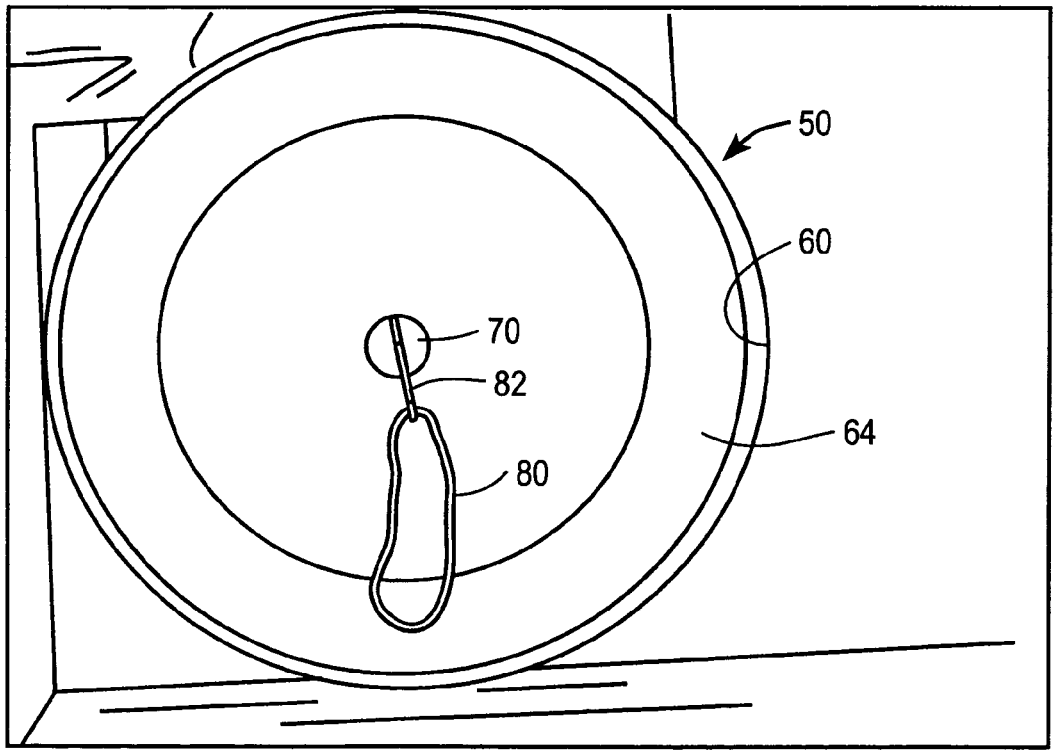
FIG. 7 is a plan view showing a bottom assembly and parts of the hold-down system suitable for use in the drum of FIG. 3.

A preferred form of the hold-down system is shown in detail in FIGS. 7 and 8. In the form shown, the hold-down system comprises an elastic loop, such as a rubber band 80, and a tie 82. Tie 82 is preferably an adjustable tie, such as a conventional cable tie with a ratchet-type closure mechanism. Note that in the arrangement of FIG. 7, an annular disk 64*a* having a stepped configuration in its thickness direction is mounted to the bottom heading in order to provide increased strength toward the outside of the drum.

Prior to closure of the tie 82, a length of the tie is passed through both slot 78 of anchoring portion 76 and the loop of rubber band 80. Thus, upon closure of the tie, both the tie and the rubber band 80 are secured to plug 70 via anchoring portion 76. A portion of rubber band 80 may be drawn upwardly through the drum, after formation of wire coil 30, for insertion of hold-down bar 32 through the loop of the band, thereby enabling compression of the wire coil with bar 32.

It will be appreciated that because tie 82 is adjustable, the effective length of the rubber band and tie assembly 80, 82 can be set as desired. Accordingly, the assembly can accommodate a wide range of drum heights and allows the compressive force on the wire coil can be set as desired.

Another approach to attaching rubber band 80 to plug 70 is simply to knot the band itself directly to anchoring portion 76. This can be accomplished by passing a first portion of the band through slot 78, back over bridge member 77 and through the remainder of the band, and then pulling the first portion tight so as to knot the band to bridge member 77. Of course, this approach does not provide the adjustability afforded by the use of tie 82.

Figure 10:
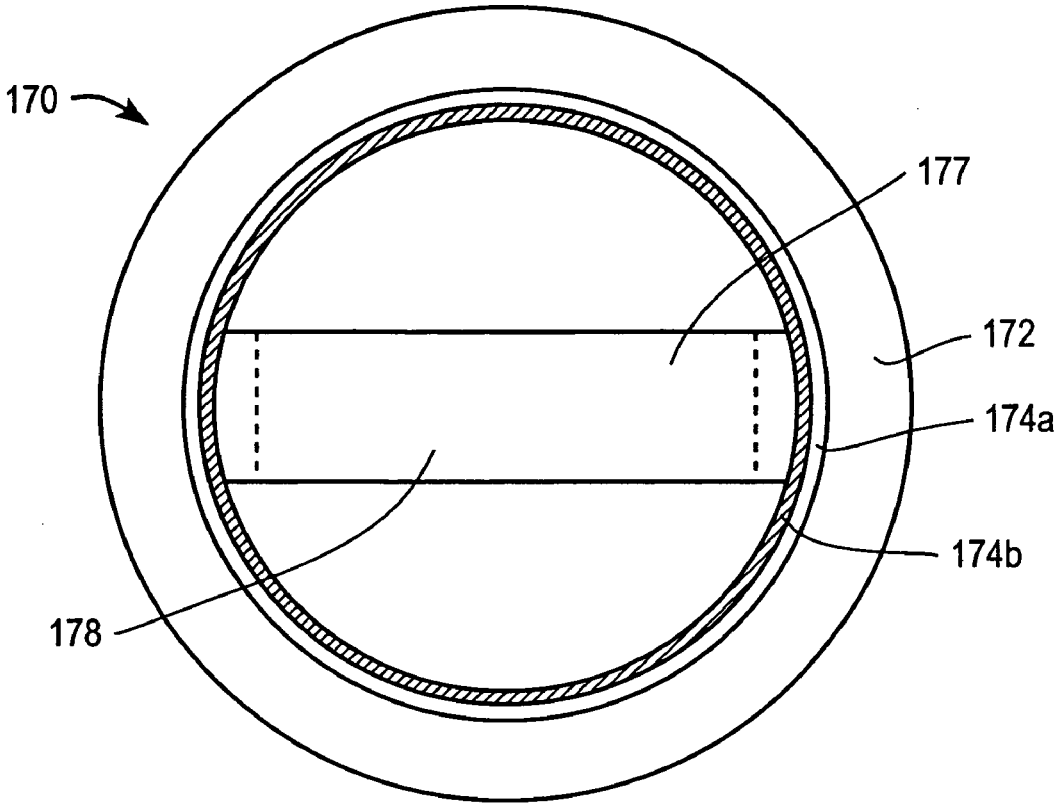
FIG. 10 is a plan view of the anchoring member in FIG. 9.
Figure 9:
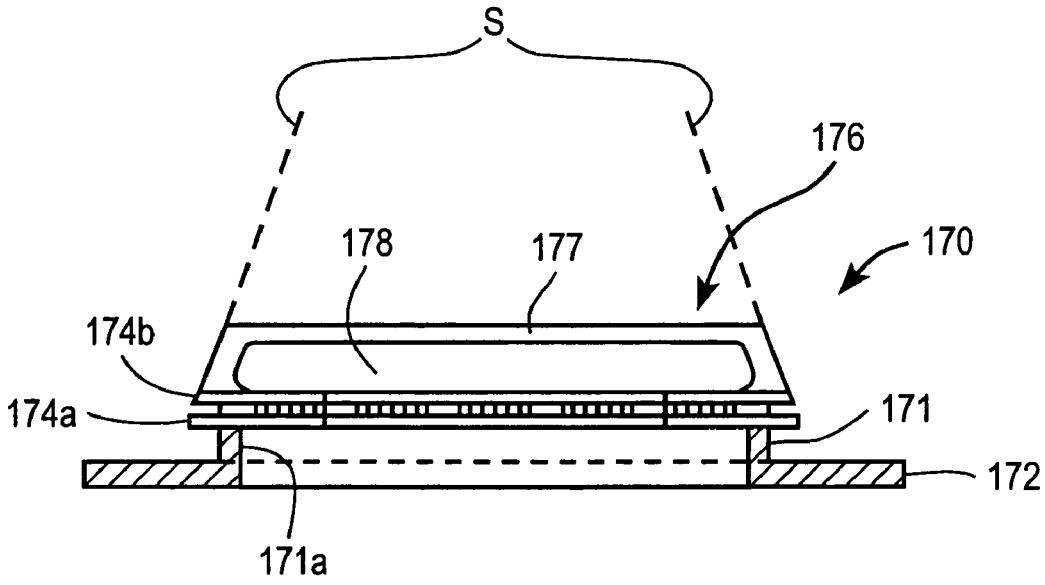
FIG. 9 is a partially sectional side view showing an alternative form of the anchoring member suitable for use with the drum of FIG. 3.

FIGS. 9 and 10 illustrate another plug 170, which is a variation of the first plug configuration described above. Like the first configuration, plug 170 has a generally cylindrical body 171 with a laterally projecting flange portion 172 at one end. In this second configuration, plug body 171 has a hollowed out design to define a recess 171*a*, thus reducing the amount of plastic required to produce the plug as previously noted. The other end portion of the plug is formed with a pair of laterally projecting resilient circumferential flanges 174*a*, 174*b*, which are axially spaced both from each other and from the flange portion 172. The outer diameters of flanges 174*a*, 174*b* are both slightly greater than the diameter of hole 62 in the drum bottom heading, and the outer diameter of flange 174*b* is also slightly less than that of flange 174*a*. The flange 174*b* thus facilitates insertion of the plug into the hole of the drum bottom heading. To further facilitate insertion of the plug, the diametrically opposite outer surfaces of the bridge member 177 and the outer circumferential edges of the flanges 174*a* and 174*b* may be formed so as to lie on a common imaginary conical surface S as indicated in FIG. 9, thus giving the upper portion of the plug a generally conical profile.

The hold-down system is attached to the opening 178 of anchoring portion 176 in the same manner as in the drum of FIG. 3.

It will be appreciated that the plug and rubber band assembly of the invention as described above may be mounted to the bottom heading either before or after the bottom heading is joined to the drum body, thus increasing flexibility of the drum assembly process. Further, the snap-mount design of the plug greatly simplifies the assembly process because it avoids the need for more labor-intensive operations associated with the attachment of the strap in a conventional drum design.

While preferred embodiments of the invention have been shown and described, these embodiments are intended to be exemplary, not restrictive. It will be apparent to those skilled in the art that modifications can be made without departing from the principles and spirit of the invention, the scope of which is set forth in the appended claims. For example, while a snap-mounted plug is preferred in practice of the invention, the plug may designed to be mounted to the drum bottom heading by press-fitting. Further, the plug need not completely cover the hole in the bottom heading, but is preferably designed to do so, as in the illustrative forms, in order to prevent (or at least substantially prevent) dirt and other foreign matter from entering the drum via the hole.

What is claimed is:

1. A bottom assembly for a container used in the packaging of a wire coil, said bottom assembly comprising a bottom-most heading and an anchoring member mounted to said bottom-most heading, wherein said anchoring member is a unitary molded plastic member, said anchoring member being inserted through a hole of said bottom-most heading and having portions disposed at opposite sides of said bottom-most heading so as to entrap said bottom-most heading therebetween, said anchoring member further having a transverse anchoring portion constructed and disposed to anchor a hold-down system for container-received wire coil.

2. A bottom assembly according to claim 1, wherein said anchoring member is snap-mounted to said bottom-most heading.

3. A bottom assembly according to claim 1, wherein said anchoring member comprises a plug having a generally cylindrical body provided with a laterally projecting flange portion and at least one resilient member, projecting laterally from said body and axially displaced from said flange portion, said plug being mounted to said bottom-most heading by insertion of said resilient member through said hole, said resilient member being constructed to resiliently deform inwardly toward said body during insertion through said hole and to return toward an initial configuration after insertion such that said bottom-most heading is entrapped between said flange portion and resilient member.

4. A bottom assembly according to claim 3, wherein said plug has a plurality of said resilient members circumferentially spaced from each other.

5. A bottom assembly according to claim 3, wherein said at least one resilient member has a bevelled circumferential edge.

6. A bottom assembly according to claim 3, wherein said plug has a laterally projecting resilient member axially spaced from said at least one resilient member to facilitate mounting of said plug to said bottom-most heading.

7. A bottom assembly according to claim 3, wherein said flange portion and said at least one resilient member are disposed substantially at opposite first and second axial ends of said plug body, respectively, and said plug further includes an anchoring portion projecting axially from said second end and having an opening for anchoring said hold-down system.

8. A bottom assembly according to claim 7, wherein said hold-down system includes an elastic loop member secured to said opening of said anchoring portion.

9. A bottom assembly according to claim 8, wherein said elastic loop member is secured to said opening by a tie passing through said opening and said elastic loop member.

10. A bottom assembly according to claim 8, wherein said elastic loop member is secured to said opening by a tie passing through said opening and said elastic loop member.

11. A bottom assembly according to claim 3, wherein said plug body is at least partially hollowed out.

12. A bottom assembly according to claim 1, wherein said anchoring portion of said anchoring member is formed with an opening for anchoring said hold-down system.

13. A bottom assembly according to claim 12, wherein said hold-down system includes an elastic loop member secured to said opening of said anchoring portion.

14. A bottom assembly according to claim 13, wherein said bottom-most heading is formed of pasteboard.

15. A bottom assembly according to claim 1, wherein said bottom-most heading is unitary.

16. A bottom assembly for a container used in packaging a wire coil, said bottom assembly comprising a bottom-most heading having a hole, and an anchoring member mounted to said bottom-most heading and cooperating with said hole such that a transverse anchoring portion of said anchoring member is disposed to anchor a hold-down system for a container-received wire coil, wherein said anchoring member is a unitary molded plastic member.

17. A bottom assembly according to claim 16, wherein said anchoring member is inserted in said hole and has portions disposed at opposite sides of said bottom-most heading so as to entrap said bottom-most heading therebetween.

18. A bottom assembly according to claim 16, wherein said anchoring portion has an opening for anchoring said hold-down system.

19. A bottom assembly according to claim 18, wherein said hold-down system includes an elastic loop member secured to said opening of said anchoring portion.

20. A bottom assembly according to claim 19, wherein said elastic loop is secured to said opening by a member passing through said opening and said elastic loop.

21. A bottom assembly according to claim 16, wherein said bottom-most heading is a unitary plastic molded member.

22. An anchoring assembly, comprising an anchoring member adapted to be mounted to a container drum bottom heading and an elastic loop member secured to said anchoring member by a tie passing through said elastic loop member, wherein said tie is a cable tie having ratchet-type closure mechanism.

23. A container for the packaging of wire coil comprising: a container body; and a bottom assembly disposed at a bottom of said container body, said bottom assembly comprising a bottom-most heading and an anchoring member mounted to said bottom-most heading, said anchoring member being inserted through a hole of said bottom-most heading and having portions disposed at opposite sides of said bottom-most heading so as to entrap said bottom-most heading therebetween, said anchoring member further having a transverse anchoring portion constructed and disposed to anchor a hold-down system for container-received wire coil, wherein said anchoring portion of said anchoring member is formed with an opening for anchoring said hold-down system.

24. A container according to claim 23, wherein said anchoring member comprises a plug having a generally cylindrical body provided with a laterally projecting flange portion and at least one resilient member, projecting laterally from said body and axially displaced from said flange portion, said plug being mounted to said bottom-most heading by insertion of said resilient member through said hole, said resilient member being constructed to resiliently deform inwardly toward said body during insertion through said hole and to return toward an initial configuration after insertion such that said bottom-most heading is entrapped between said flange portion and resilient member.

25. A container according to claim 24, wherein said plug has a plurality of said resilient members circumferentially spaced from each other.

26. A container according to claim 24, wherein said at least one resilient member has a bevelled circumferential edge.

27. A container according to claim 24, wherein said plug has a laterally projecting resilient member axially spaced from said at least one resilient member to facilitate mounting of said plug to said bottom-most heading.

28. A container according to claim 24, wherein said flange portion and said at least one resilient member are disposed substantially at opposite first and second axial ends of said plug body, respectively, and said plug further includes an anchoring portion projecting axially from said second end and having an opening for anchoring said hold-down system.

29. A container according to claim 28, wherein said hold-down system includes an elastic loop member secured to said opening of said anchoring portion.

30. A container according to claim 29, wherein said elastic loop member is secured to said opening by a tie passing through said opening and said elastic loop member.

31. A container according to claim 29, wherein said elastic loop member is secured to said opening by a tie passing through said opening and said elastic loop member.

32. A container according to claim 24, wherein said plug body is at least partially hollowed out.

33. A container according to claim 23, wherein said hold-down system includes an elastic loop member secured to said opening of said anchoring portion.

34. A container according to claim 33, wherein said bottom-most heading is formed of pasteboard.

* * * * *

UNITED STATES PATENT AND TRADEMARK OFFICE

CERTIFICATE OF CORRECTION

PATENT NO. : 7,172,070 B2
APPLICATION NO. : 09/937282
DATED : February 6, 2007
INVENTOR(S) : Thomas D. Coon et al.

It is certified that error appears in the above-identified patent and that said Letters Patent is hereby corrected as shown below:

Item (86); §371. (c)(1), (2), (4) Date:

Please replace "Dec. 28, 2001" with --Dec. 21, 2001--;

Abstract

Please replace "A game machine (2, 200) which includes a playing field (6, 301) traversed by objects, such as balls (320). The playing field can have plural drop zones (381-383) which can be selected by the player using deflectors (108-110) that control where the balls are launched. Detectors (22, 392) indicate scoring positions assumed by the balls. A payline display (28, 335) displays scored events. A symbol selector is included to select symbols which are variably assigned to the scoring positions and displayed on displays (20, 397). The balls score symbols which can be displayed in the payline display and affect winning or bonus play. Game machine (200) includes traditional slot machine reels which works in conjunction therewith" with --An improved wire-coil packaging drum comprises a drum (10A) with a bottom heading (60) having a hole (62), and an anchoring member mounted to the bottom heading (60) and cooperating with the hole (62) such that an anchoring portion (76) of the anchoring member (70) is disposed to anchor a hold-down system for a wire coil received in the drum. The anchoring member may comprise a snap-mounted plug that is conveniently inserted into the hole (62) of the bottom heading (60), with the hold-down system comprising an elastic loop, such as a rubber band (80), which may be secured to the plug by a cable tie (82) or the like--.

Signed and Sealed this

Tenth Day of April, 2007

JON W. DUDAS
*Director of the United States Patent and Trademark Office*